US006205791B1

(12) United States Patent
Smith, Jr.

(10) Patent No.: US 6,205,791 B1
(45) Date of Patent: Mar. 27, 2001

(54) HIGH EFFICIENCY MODULAR CRYOCOOLER WITH FLOATING PISTON EXPANDER

(75) Inventor: Joseph L. Smith, Jr., Concord, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/347,353

(22) Filed: Jul. 6, 1999

(51) Int. Cl.[7] ..... F25B 9/00; F01B 29/10
(52) U.S. Cl. ..... 62/6; 60/520
(58) Field of Search ..... 62/6; 60/520

(56) References Cited

U.S. PATENT DOCUMENTS

| | | | | |
|---|---|---|---|---|
| 2,607,322 | | 8/1952 | Collins | 121/117 |
| 3,045,436 | | 7/1962 | Gifford et al. | 62/6 |
| 3,119,237 | | 1/1964 | Gifford | 62/6 |
| 3,274,786 | * | 9/1966 | Hogan et al. | 62/6 |
| 3,421,331 | * | 1/1969 | Webb | 62/6 |
| 3,438,220 | | 4/1969 | Collins | 62/6 |
| 3,609,982 | * | 10/1971 | O'Neil et al. | 62/6 |
| 4,354,355 | * | 10/1982 | Lawless | 62/6 |
| 4,862,694 | | 9/1989 | Crunkleton et al. | 62/6 |
| 5,211,372 | | 5/1993 | Smtih, Jr. | 251/75 |

OTHER PUBLICATIONS

T. Kuriyama et al., Optimization of Operational Parameters for a 4K–GM Refrigerator, *Advances in Cryogenic Engineering*, vol. 41, 1996, pp. 1615–1518.

P.E. Bradley et al., A Three–Stage Pulse Tube Refrigerator For Temparatures Near 4K, *Advances in Cryogenic Engineering*, vol. 41, 1996, pp. 1511–1518.

R.E. Jones, Design and Testing of Experimental Free–Piston Cryogenic Expander, Masters Thesis, MIT, Feb. 1999.

* cited by examiner

*Primary Examiner*—William Doerrler
(74) *Attorney, Agent, or Firm*—Sampson & Associates

(57) ABSTRACT

A compact, modular, cryocooler is provided for use in relatively small-scale applications, i.e., applications requiring less than approximately 10 Watts of cooling capacity at about 10 degrees K or less. The cryocooler 10 utilizes a recuperative heat exchanger integrally combined with a floating piston expander having a piston adapted for periodic movement within an expansion cylinder. The piston is actuatable without an external drive mechanism, but rather by selective operation of processor controlled "smart", variable current pulse valves which serve to alternately couple working fluid and ballast fluid to opposite ends of the cylinder. The valves are actuated in response to output signals generated by a non-invasive inductive sensor, which detects the position of the piston within the cylinder. The combination of the floating piston expander, as precisely controlled by the sensor, smart valves and a processor, with the recuperative heat exchanger, provides improved thermal efficiency relative to conventional small scale cryocoolers which typically utilize regenerative heat exchangers. The floating piston expander and recuperative heat exchanger are fabricated as an integrated, modular unit, which facilitates scaling to N modular units. Only a single flow-path is required to connect adjacent modular units to advantageously simplify both scaling and manifold construction.

37 Claims, 6 Drawing Sheets

HIGH EFFICIENCY MODULAR CRYOCOOLER WITH FLOATING PISTON EXPANDER

BACKGROUND OF THE INVENTION

1. Appendix

One appendix is filed with this application. Appendix A is a software code listing comprising a total of 5 pages.

2. Field of the Invention

This invention relates to a cryogenic refrigerant apparatus for providing a fluid at low temperatures and, more particularly, to such an apparatus which permits such low temperatures to be achieved in an efficient manner even when the size of the apparatus is reduced in scale.

3. Background Information

Two well known techniques have been suggested for use in achieving low temperature or cryogenic operation, particularly using helium as a fluid, for example. One approach is referred to as a Collins Cycle (or alternatively referred to as a multi-stage Claude Cycle). The Collins Cycle is used to provide refrigeration or liquefaction at "liquid-helium" temperatures. The Claude Cycle is used to provide refrigeration or liquefaction at higher temperatures using fluids such as nitrogen. Improvements and modifications to this basic technique have also been described in U.S. Pat. Nos. 2,607,322 and 3,438,220, for example, issued S. C. Collins on Aug. 19, 1952 and Apr. 15, 1969, respectively.

In such approach, high pressure fluid from a compressor is passed through a heat exchanger and introduced, via a high pressure valve, into an expansion engine comprising a chamber having a movable member such as a piston positioned therein. When the fluid is so introduced, the piston moves within the chamber to form an expansion volume, the expansion of the fluid causing the heat energy to be transferred therefrom via the performance of mechanical work, as on a crank shaft, for example, connected to the piston. In the expansion operation, the temperature and pressure of the fluid are reduced considerably. The fluid is then conveyed via a low pressure valve from the expansion volume to a space to be cooled, for example, and then back to the compressor in a counter current flow through the heat exchanger.

While the Collins Cycle technique is effective when used for relatively large-scale production of low temperature helium, for example, it has been found to be difficult to scale down the apparatus size when a smaller system is required and still retain the low temperature effectiveness thereof.

Another approach used in the art to achieve low temperature operation is often referred to as the Gifford-McMahon Cycle Technique, an approach that has sometimes been proposed as effective when used for such smaller scale systems. The Gifford-McMahon Cycle is commonly used in single and multiple stage configurations. A multi-stage Gifford-McMahon Cycle, however is generally incapable of producing liquid-helium temperatures with conventional regenerator materials, as will be discussed hereinbelow. Refrigeration in a Gifford-McMahon operation results from a difference in enthalpy between the entering high pressure stream and the exiting low pressure stream. A basic description of the Gifford-McMahon operation is set forth in U.S. Pat. No. 3,045,436, issued on Jul. 24, 1962 to W. E. Gifford and H. O. McMahon. Other apparatus using Gifford-McMahon principles of operation are also described, for example, in U.S. Pat. Nos. 3,119,237 and 3,421,331 issued on Jan. 28, 1964 and Jan. 14, 1969 to W. E. Gifford and J. E. Webb, respectively.

In such systems, no heat energy is transferred from the expanding fluid through the performance of mechanical work external to the refrigerator. While a movable displacer element is periodically moved within the apparatus to provide for an expansion chamber, such element is not arranged so as to produce mechanical energy exchange. Rather, multiple confined fluid volumes are balanced so as to act in conjunction with one another so that compression and expansion are selectively controlled using inlet and exhaust valves at room temperatures and a net refrigeration is produced at one or more points in the system.

In such an approach, the confined fluid volumes on either end of the displacer are connected by a heat exchange passage called a thermal regenerator, as mentioned hereinabove. Those skilled in the art will recognize that the term thermoregenerator refers to bi-directional heat exchangers which often have been selected for relatively small scale refrigeration systems due to their mechanical simplicity, as will be discussed in greater detail hereinbelow. Thus in this Gifford-McMahon configuration, the regenerator undergoes the same pressure cycling as the confined fluid volumes. In this configuration, the heat energy is normally fully stored for a half cycle in the regenerator matrix, which requires the regenerator matrix to have a relatively large heat capacity. In totally regenerative cycles, such as in the Gifford-McMahon approach, the pressure ratio is effectively limited by the gas volume in the regenerator, which must be large enough so that the low pressure flow pressure drop through the regenerator matrix is not excessive. A similar cycle that employs regenerative heat exchangers is known as the Sterling cycle.

Common regenerator materials have a heat capacity that diminishes at very low temperatures. For this reason, early Gifford-McMahon Cycle machines alone have not been capable of producing cooling at liquid helium temperatures, even when multiple stages are used. To reach liquid helium temperatures, a second thermodynamic cycle such as a Joule-Thomson Cycle was generally used in parallel with the Gifford-McMahon Cycle. The Joule-Thomson Cycle consists of a pre-cooling counterflow heat exchanger and an expansion valve (commonly referred to as the Joule-Thomson expansion valve). Neither the Gifford-McMahon nor the Joule-Thomson cycles were capable of reaching liquid helium temperatures independently. The Gifford-McMahon stages provided pre-cooling of the helium gas in a counterflow heat exchanger of the Joule-Thomson Cycle in preparation to expand the gas over the Joule-Thomson expansion valve. This combined cycle configuration is capable of producing cooling at liquid helium temperatures. However, integrating these two cycled configurations is undesirable for at least two reasons. First, mechanically combining the two configurations is somewhat cumbersome, especially during manufacture. Second, the optimal mean cycle pressures and pressure ratios for the two cycles are not compatible, which requires a special compressor configuration.

More recently, small scale Gifford-McMahon cycle machines have been developed that may produce one Watt or less of cooling capacity at liquid helium temperature. These machines achieve such performance by use of rare earth materials (such as erbium three nickel) as the regenerator material, such as developed by Toshiba of Japan. While these machines may operate satisfactorily in some applications, they provide relatively low efficiency and generally have been limited to a capacity of one Watt or less at liquid helium temperatures.

Thus, existing technology for cryogenic cooling on a relatively small scale i.e., for cooling of electronics and the like, is either overly expensive, to large and/or heavy, or inefficient. There is a need for a compact, lightweight, efficient, and low cost cryocooler which can provide approximately 10 Watts or less of cooling capacity at about 10 degrees Kelvin (K) or less for use with terrestrially deployed electronic devices such as superconductors, digital circuits and subsystems, Josephson voltage standards, and long wavelength infrared imaging cameras. Previous attempts to reduce the cost of small cryocoolers have aimed at simplifying the process (e.g., pulse-tube refrigerators, thermoelectrics) and/or reducing system or mechanical complexity. Disadvantageously, such simplifications have failed to attain or even approach the efficiency levels of the large scale systems that employ more complex cycles.

Large scale machines, such as those used in the production of liquid helium, are generally based on the Brayton or Collins Cycles. The cycles may be characterized as employing constant pressure, quasi-steady, recuperative heat exchange between the high and low-pressure gas streams, thereby requiring a two-stream (i.e., recuperative) heat exchanger. This compares with the variable pressure, periodic, regenerative heat exchange of the Sterling or Gifford-McMahon Cycles, which as discussed hereinabove, are typically used in small scale machines, due in part, to the relatively less complex and less expensive single-stream (i.e., bi-directional) regenerator. The small scale Brayton and Collins Cycle machines also require valved expanders and compressors, whereas the simpler regenerative cycles are valveless or have only warm valves (i.e., in the Gifford-McMahon Cycle). Heretofore, the relative complexity of these valved recuperative cycles has ruled out their use in low-cost machines utilized for the above-described, relatively small-scale applications of approximately 10 Watts of cooling capacity at about 10 degrees K or less. A comparison of thermodynamic efficiency at liquid nitrogen temperature (77K) shows however that the large scale, high efficiency machines based on the Brayton and Collins Cycles routinely achieve 25 percent of Carnot-efficiency at 77K (10 percent of Carnot-efficiency at 4K). The relatively simple machines such as the Gifford McMahon and/or pulse-tube systems typically achieve less than 10 percent of Carnot-efficiency at 77K.

Thus, a need exists for an improved cryocooler, which provides convenient scalability to small scale applications while maintaining relatively high energy efficiency associated with larger scale systems.

Throughout this application, various publications and patents are referred to by an identifying citation. The disclosures of the publications and patents referenced in this application are hereby incorporated by reference into the present disclosure.

SUMMARY OF THE INVENTION

An important aspect of the present invention was the realization that an efficient, small-scale cryocooler may be provided by use of a recuperative heat exchanger in combination with a floating piston expander. Surprisingly, it was discovered that a recuperative, rather than regenerative heat exchanger, may be utilized in combination with such an expander to provide relatively high refrigeration efficiencies, particularly in small-scale cryocoolers, i.e., those providing approximately 10 Watts or less of cooling capacity at about 10 degrees K or less.

The present invention provides, in a first aspect, a system for providing a low temperature fluid. The system includes a compressor, a recuperative heat exchanger disposed in fluid communication with the compressor and a floating piston expander disposed in fluid communication with the heat exchanger.

The present invention provides, in a second aspect, an expander adapted for use in a thermodynamic cycle. The expander includes an expansion chamber and piston adapted for periodic movement within the expansion chamber. The piston is free from an external drive mechanism and is actuated by alternately coupling and decoupling fluid thereto. A plurality of variable force valves effect the coupling and decoupling and a sensor is provided to detect the location of the piston within the expansion chamber. The sensor is free from physical contact with the piston and a computer is coupled to the sensor to control operation of the variable force valves.

A third aspect of the present invention includes a system for providing a low temperature fluid. The system includes a compressor to provide fluid under pressure, the compressor having an input and an output. A heat exchanger is disposed in fluid communication with the compressor, the heat exchanger having discrete first and second flow paths extending therethrough. The first flow path is coupled to the input and the second flow path is coupled to the output. A floating piston expander is disposed in serial fluid communication with the first and second flow paths, wherein the first flow path is coupled through the floating piston expander to the second flow path. The floating piston expander has a piston disposed for periodic axial movement within an elongated chamber, the piston having a range of motion extending between a cold displacement volume disposed at one end of the chamber and a warm displacement volume disposed at an other end of the chamber. The first and second flow paths are selectively coupled to the cold displacement volume and first and second ballast volumes are selectively coupled to the warm displacement volume. The first and second ballast volumes are alternately couplable to the warm displacement volume to generate movement of the piston from the cold displacement volume towards the warm displacement volume and generate substantially isentropic expansion of the fluid under pressure disposed within the cold displacement volume.

A fourth aspect of the present invention is a method for producing a cold fluid. The method includes the steps of:

(a) utilizing a compressor having an input and an output to provide fluid under pressure;

(b) disposing a heat exchanger in fluid communication with the compressor, the heat exchanger having discrete first and second flow paths extending therethrough, the first flow path being coupled to the input and the second flow path being coupled to the output;

(c) disposing a floating piston expander in serial fluid communication with the first and second flow paths, the floating piston expander having a piston adapted for periodic, axial movement within an expansion chamber, the piston having a range of motion extending between warm and cold displacement volumes disposed at opposite ends of the expansion chamber, wherein the first flow path is selectively coupled through the cold displacement volume of the floating piston expander to the second flow path;

(d) introducing the fluid under pressure at a first temperature through the first flow path into the cold displacement volume;

(e) pre-cooling the fluid flowing in the first flow path from the first temperature to a second temperature lower than the first temperature;

(f) periodically coupling a low pressure fluid to the warm displacement volume to generate movement of the piston from the cold displacement volume towards the warm displacement volume to expand the cold displacement volume and expand the pressurized fluid flowing into the cold displacement volume from the first flow path from the pressure to a substantially lower pressure to reduce the temperature thereof to a temperature substantially lower than the second temperature;

(g) decoupling the low pressure fluid from the warm displacement volume and coupling a high pressure fluid to the warm displacement volume to move the piston towards the cold displacement volume to cause fluid at the third temperature and at the lower pressure to flow from the cold displacement volume at a substantially constant pressure into the second flow path;

(h) providing a direct heat exchange between fluid flowing in the first flow path and fluid flowing in the second flow path to effect the pre-cooling of the fluid flowing in the first flow path substantially to the second temperature and a warming of the fluid flowing in the second flow path; and (i) supplying the fluid from the second flow path to the compressor to provide the fluid under pressure for introduction into the first flow path.

More specific aspects of the present invention include methods and apparatus which utilize a floating piston expander having a piston disposed for axial movement within an elongated chamber between a cold displacement volume disposed at one end of said chamber and a warm displacement volume disposed at an other end of said chamber, in which the first and second flow paths are selectively coupled to the cold displacement volume and the first and second ballast volumes are selectively coupled to the warm displacement volume. The first and second ballast volumes are alternately coupled to the warm displacement volume through at least one flow restriction to generate movement of the piston from the cold displacement volume towards the warm displacement volume and generate substantially isentropic expansion of the fluid under pressure disposed within the cold displacement volume.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
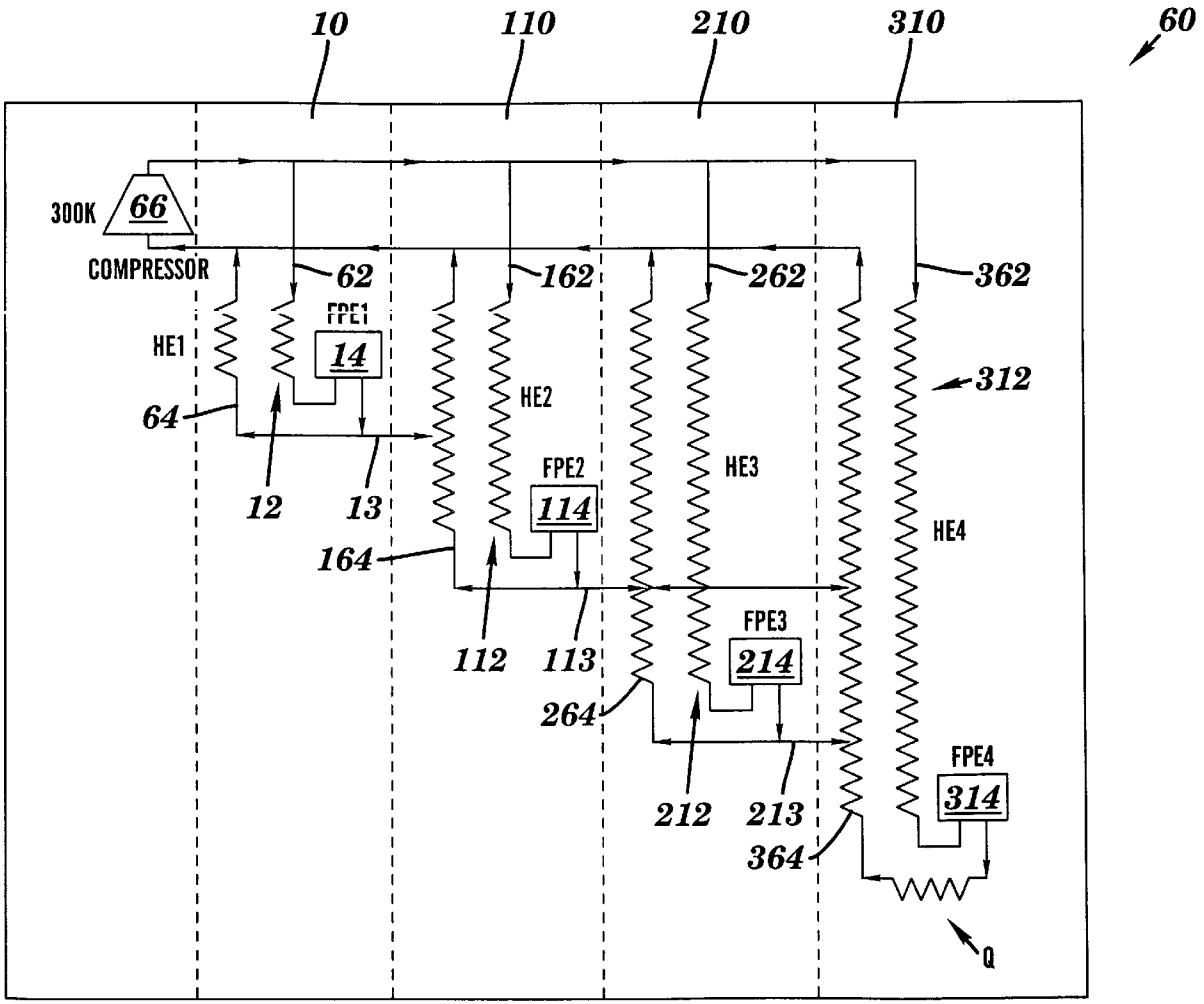
FIG. 1 is a schematic representation of a multi-stage cryocooler system of the present invention.

Referring to the figures set forth in the accompanying Drawings, the illustrative embodiments of the present invention will be described in detail hereinbelow. For clarity of exposition, like features shown in the accompanying Drawings shall be indicated with like reference numerals and similar features as shown in alternate embodiments in the Drawings shall be indicated with similar reference numerals. Referring to the Figures, the apparatus and system constructed according to the principles of the present invention is shown.

Figure 2:
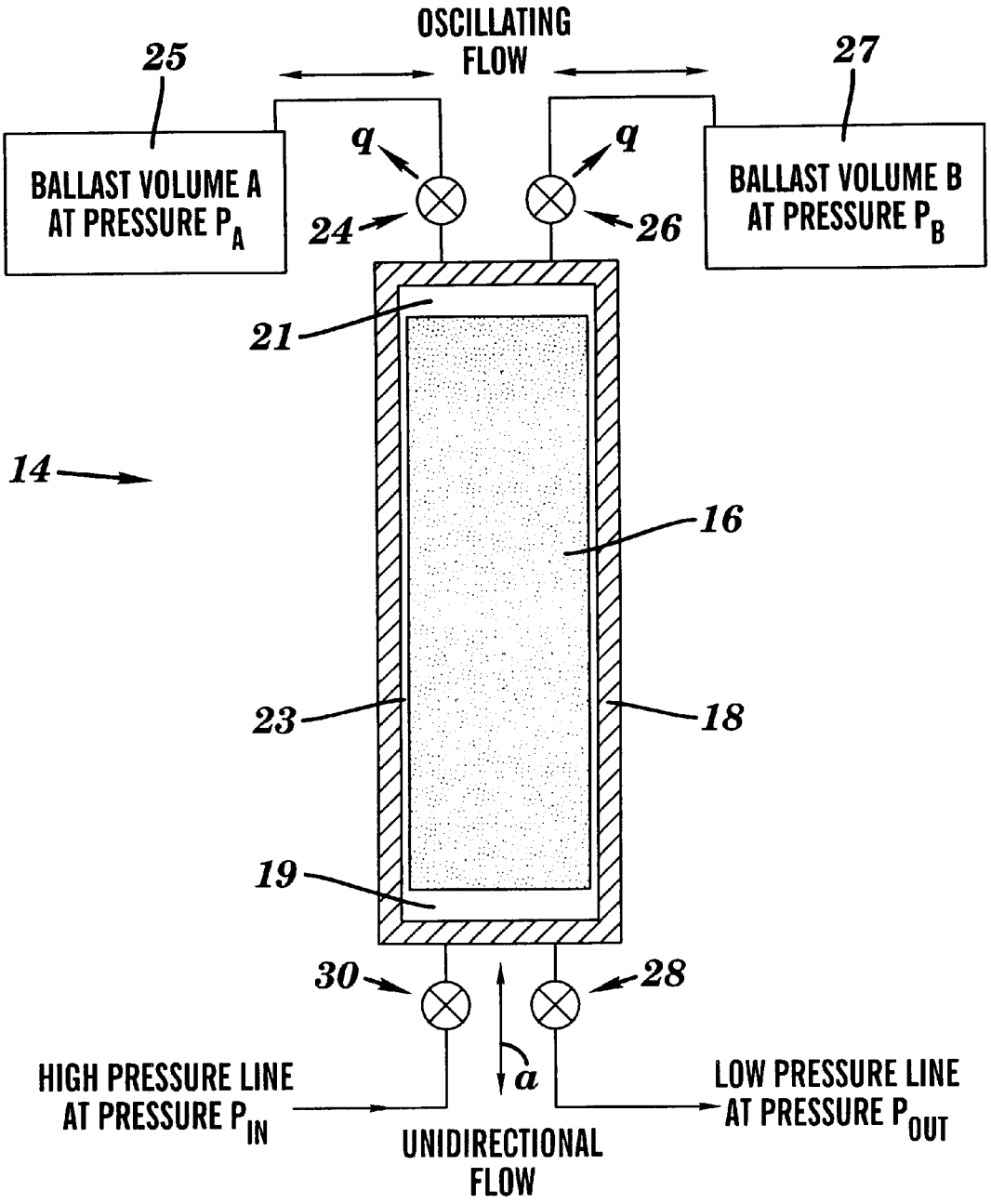
FIG. 2 is a schematic representation, with portions thereof shown in cross section, of a floating piston expander of the present invention.
Figure 4:
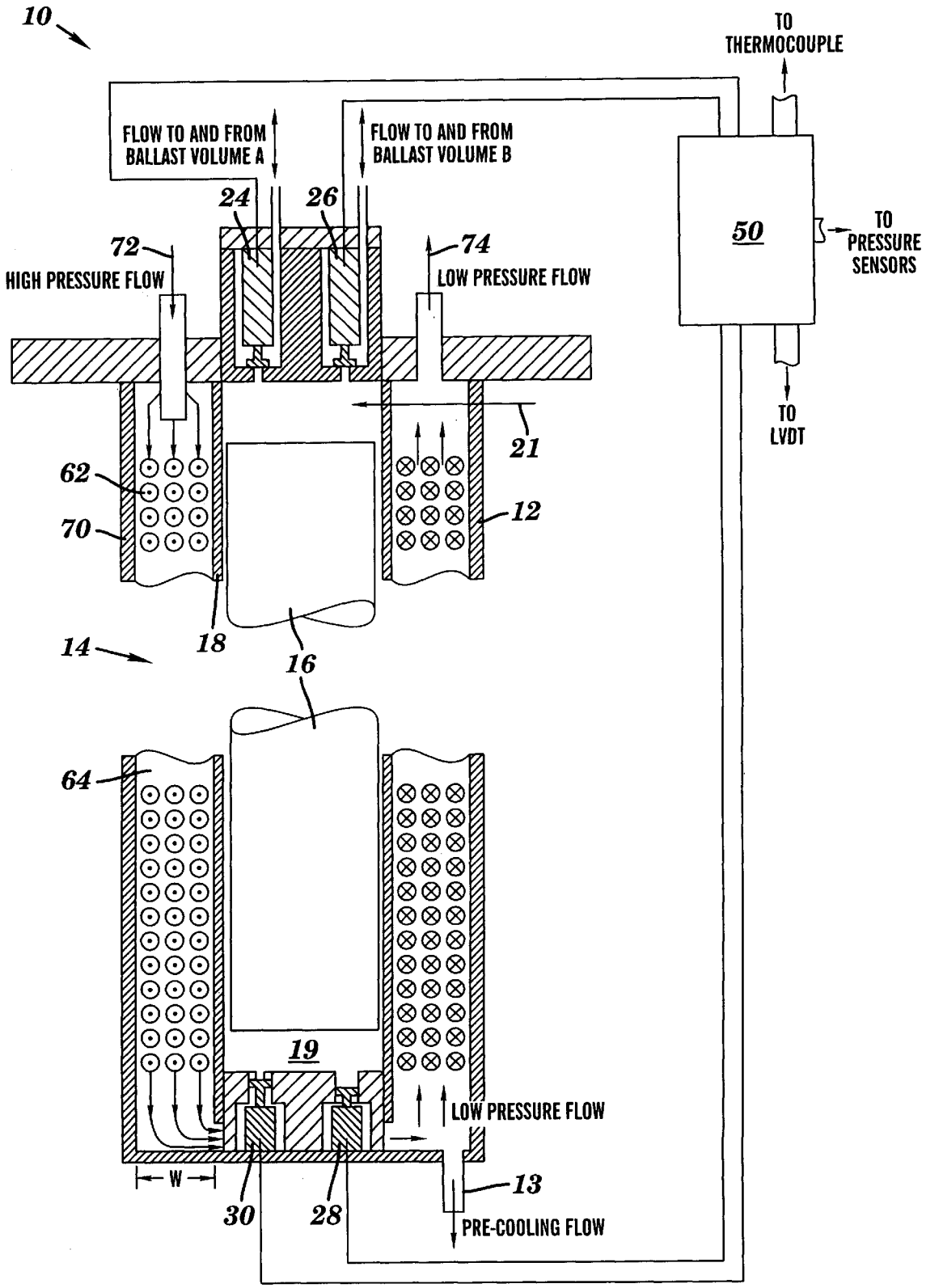
FIG. 4 is a cross-sectional, diagrammatic view, on an enlarged scale, of portions of a cryocooler module of FIG. 1, which incorporates the floating piston expander of FIG. 2.

Briefly described, the invention is a compact, modular, cryocooler 10 (FIGS. 1 & 4) for use in relatively small scale applications, i.e., applications requiring less than approximately 10 W of cooling capacity at about 10 degrees K or less. The cryocooler 10 utilizes a recuperative (continuous, unidirectional flow) heat exchanger 12 (FIGS. 1 & 4) integrally combined with a floating piston expander 14 having a piston (displacer) 16 adapted for periodic movement within an expansion cylinder 18 (FIGS. 2 & 4). The piston 16 is actuatable without an external drive mechanism, but rather by selective operation of microprocessor controlled "smart" (variable current pulse) valves 24, 26, 28 & 30 (FIG. 2) which serve to alternately couple working fluid and ballast fluid to opposite ends of the cylinder 18.

The valves are actuated in response to output signals generated by a non-invasive inductive sensor 40 (FIG. 5) that detects the position of the piston 16 within the cylinder 18. An important aspect of the invention is the control sequence of the warm valve actuation, in combination with rate-limiting throttling action of the warm valves, to create a nearly ideal (i.e., substantially isentropic) expansion of the gas disposed within the cold volume 19.

The combination of the floating piston expander 14, as controlled by the aforementioned sensor 40, smart valves and microprocessor 50, with the recuperative heat exchanger 12, provides improved fluid pressure and mass flow characteristics relative to conventional small scale regenerative (single passage) heat exchangers.

The floating piston expander 14 and recuperative heat exchanger 12 are fabricated as an integrated, modular unit that facilitates scaling to N modular units. In this regard, only a single flow-path 13 is required to connect adjacent modular units to advantageously simplify both scaling and manifold construction.

It has been found that the present invention provides such improved efficiency, in part, by utilizing the ballast volumes to eliminate the need for mechanically dissipating the work generated by expansion of the working fluid. Moreover, a particularly significant aspect is the use of sequentially coupling of the ballast volumes at the warm volume of the expander to generate nearly ideal (isentropic) expansion of the working fluid at the cold volume. This aspect is facilitated by use of the throttling valves to limit the rate of expansion of the working fluid and by decoupling the cold volume from the first flow path when the piston reaches a predetermined position prior to reaching the warm end of its stroke. Disposing the rate limiting functions within the warm end of the expander reduces thermal losses for further improvements in efficiency.

The use of self-regulating or stable steady-state ballast pressure volumes effectively eliminates the need for high-pressure seals between the floating piston and the expansion cylinder to simplify, increase life and reduce expense relative to the prior art.

Where used in this disclosure, the term "axial" when used in connection with an element described herein, shall refer to a direction relative to the element, which is substantially parallel to the direction of reciprocal movement a of piston 16 within cylinder 18 as shown in FIG. 2. Similarly, the term "transverse" shall refer to a direction substantially orthogonal to the axial direction. The term "transverse cross-section" shall refer to a cross-section or circumference, respectively, taken along a plane oriented substantially orthogonally to the axial direction. The term "smart" valve shall mean any valve controllable by a microprocessor or similar control device whether embedded or disposed remotely relative thereto. The terms "microprocessor", "processor" and "computer" shall refer to any electronic processing device including a personal computer or other discreet or embedded processing device. The term "floating piston" refers to a low compliance (substantially incompressible) member sized and shaped for sliding receipt within an elongated chamber. As discussed in greater detail hereinbelow, the member is of sufficiently low mass so that it reciprocates axially within the chamber in response to fluid pressure differences at opposite ends thereof, nominally without converting any substantial part of the mechanical work being transferred from the cold volume to the warm volume, into kinetic energy of the piston, to thus avoid reducing expander efficiency due to unnecessary expansion and compression of the gas in the cold volume.

Each modular cryocooler 110, 210 and 310 (FIG. 1) is substantially identical to cryocooler 10, with exception of the axial lengths thereof. For simplicity, only the cryocooler 10 will be described in detail, with those skilled in the art recognizing that such description will be applicable to the other modular cryocoolers 110, 210, 310, etc., coupled thereto.

Referring now to the Figures in greater detail, the apparatus of the present invention will be more thoroughly described. As shown in FIG. 1, a cryocooler system 60 of the present invention includes a series of cryocooler modules 10 of the present invention as shown as 10, 110, 210 and 310. Each module contains a two passage uni-directional (i.e., recuperative) heat exchanger 12 with high and low pressure (i.e., first and second) flow paths 62 and 64, respectively, passing therethrough. Each module also includes a floating piston expander 14. A high compression ratio compressor (i.e., 18 to 1) 66 supplies a working fluid such as high pressure helium to each of the modules. In the first module (module 10), the high-pressure helium gas is cooled (i.e., to about 205 degrees K) by passing through first heat exchanger (heat exchanger 12). The cooled high-pressure fluid then enters the floating piston expander 14 and is adiabatically expanded to lower the temperature of the fluid (i.e., to about 102K). The low pressure helium flow emerging from expander 14 is then split to return a portion of the gas to the compressor through the low pressure flow path 64 of heat exchanger 12, with the remaining low pressure gas channeled through output pathway 13 to the low pressure flow path 164 of the heat exchanger 112 of the second module 110. The low pressure return gas in second flow path 64 of heat exchanger 12 pre-cools the incoming stream of high pressure helium in high pressure flow path 62. The low pressure return gas that enters flow path 164 of heat exchanger 112 through flow path 13 helps pre-cool the incoming stream of high pressure helium within flow path 162 of module 110. In this regard, flow path 13 intersects with the low pressure flow path 164 at a predetermined location in which the fluid flowing in path 164 has a temperature at or above the temperature of the low pressure fluid being supplied through channel 13.

Expander 114 expands the high-pressure gas that has been pre-cooled by heat exchanger 112. Part of the low pressure discharge from the expander 114 (which has been cooled further, i.e., to about 38K in an exemplary embodiment) is fed through channel 113 to second flow path 264 to pre-cool the high pressure helium entering flow path 262 of heat exchanger 210. Similarly, module 210 supplies cooled low pressure helium (for example, at about 14K) to the second flow path 364 of the fourth heat exchanger 312 to help pre-cool the gas entering flow path 362 prior to entering expander 314. The low-pressure discharge of expander 314 (i.e., at about 10K or less) absorbs the heat load Q before returning to the low-pressure side 364 of heat exchanger 312. An analysis of this system 60 projects an estimated power input of about 62 Watts for 0.1 Watts of cooling power at 10K. This analysis assumes that the individual components are not ideal. For example, the expanders are assumed to have an adiabatic efficiency of 75 percent and the warm portion of each heat exchanger is assumed to have a constant $\Delta T/T$ of 0.075. In this regard, the 75% efficiency for the expander is provided in part, by the aforementioned sequencing of the warm valves 24 and 26 so as to produce a nearly ideal (i.e., substantially isentropic) expansion of the cold gas (i.e., working fluid) through the cold displacement volume 19. These efficiency values are routinely achieved in conventional Collins refrigerator systems. The compressor is assumed to have an isothermal efficiency of about 50 percent. The skilled artisan will recognize that individual components having greater or lesser efficiencies and/or capacity, and a greater or lesser number N of modules may be utilized to achieve greater or lesser overall system efficiency and/or fluid temperatures at individual modules, without departing from the spirit and scope of the present invention.

Turning now to FIG. 2, the floating piston expander 14 is shown in greater detail. The expander 14 includes a low mass piston (i.e. displacer) 16 that floats with the fluid in a closed cylinder 18 to form cold and warm displacement volumes 19 and 21, at opposite ends thereof. At the cold volume 19 end of the cylinder 18, high pressure gas is admitted through a microprocessor controlled "smart" electromagnetic inlet valve 30 and low pressure gas is exhausted through a similar "smart" electromagnetic exhaust valve 28. Valves 28 and 30 will be discussed in greater detail hereinbelow. A microprocessor 50 (FIG. 4) controls the opening and closing of the valves as will be discussed hereinbelow, to achieve a nearly isentropic expansion of the gas. The piston (displacer) 16 floating in the cylinder 18 moves axially (with a small axial pressure difference due to the low piston mass) to balance the pressure in the warm end volume 21 with the pressure in the cold end volume 19. To accomplish this, a pair of smart ballast volume valves 24 and 26 respectively connects the warm displacement volume 21 to closed ballast volumes 25 and 27. The ballast volume valves 24 and 26 are "smart" valves of the type utilized as valves 28 and 30 and are similarly controlled by microprocessor 50 in coordination with the cold end valves 28 and 30 to achieve nearly isentropic expansion of the cold gas supplied through cold end valve 30 to the cold displacement volume 19 and exhausted from the cold displacement volume 19 through cold end valve 28.

The work produced by the expansion of the cold gas in displacement volume 19 is transmitted by the movement of the floating piston 16 to the gas in the warm gas volume 21 to compress the warm gas. The rate of warm gas flow through the warm valves 24 and 26 is determined by the throttling action of the warm valves to achieve the aforementioned nearly isentropic expansion of the working fluid within the cold displacement volume 19. The cold valves 28 and 30 are free breathing (i.e., provide substantially no restriction when in their fully opened positions) while the warm valves 24 and 26 include flow restrictions that tend to dissipate, by the release of heat (q), the compression work delivered to warm gas by the floating piston 16. Placement of these rate-limiting throttling valves 24 and 26 at the warm volume 21 end of the expander tends to improve thermal efficiency of the expander by effectively isolating the release of the heat (q) from the cold displacement volume 19, to thus avoid disadvantageously increasing the temperature of the working fluid.

Thus, as discussed hereinabove, the floating piston 16 is a low compliance member of relatively low mass, to reciprocate axially within the chamber 18 in response to relatively small fluid pressure differences between the cold and warm volumes 19 and 21. In this manner, the piston 16 provides a substantially direct transfer of energy between volumes 19 and 21, nominally without any energy transfer generated by compression/expansion of the piston itself. Moreover, the present invention does not rely on the momentum of a high-mass piston to form a resonant system such as typically utilized by conventional free-piston Sterling cryocoolers.

In an exemplary embodiment, the piston 16 may be fabricated from a low-density closed-cell expanded polymeric or metallic foam, or may be fabricated as a hollow member (i.e., cylinder) from a lightweight material such as a composite or a metal such as a low thermal conductivity titanium alloy. The piston also may be fabricated utilizing a combination of the above, such as utilizing a hollow member having a foam core to provide desired structural integrity.

One skilled in the art will recognize that the axial length of the floating piston 16 is preferably selected to sufficiently isolate the cold displacement volume 19 from the warm displacement volume 21, without excessively increasing the mass of the piston. In this regard, increasing the length advantageously increases the aforementioned regenerative effect imposed upon any fluid leaked into the gap 23. In an exemplary embodiment discussed herein, the piston has a length within a range of 10 to 20 inches.

Figure 3:
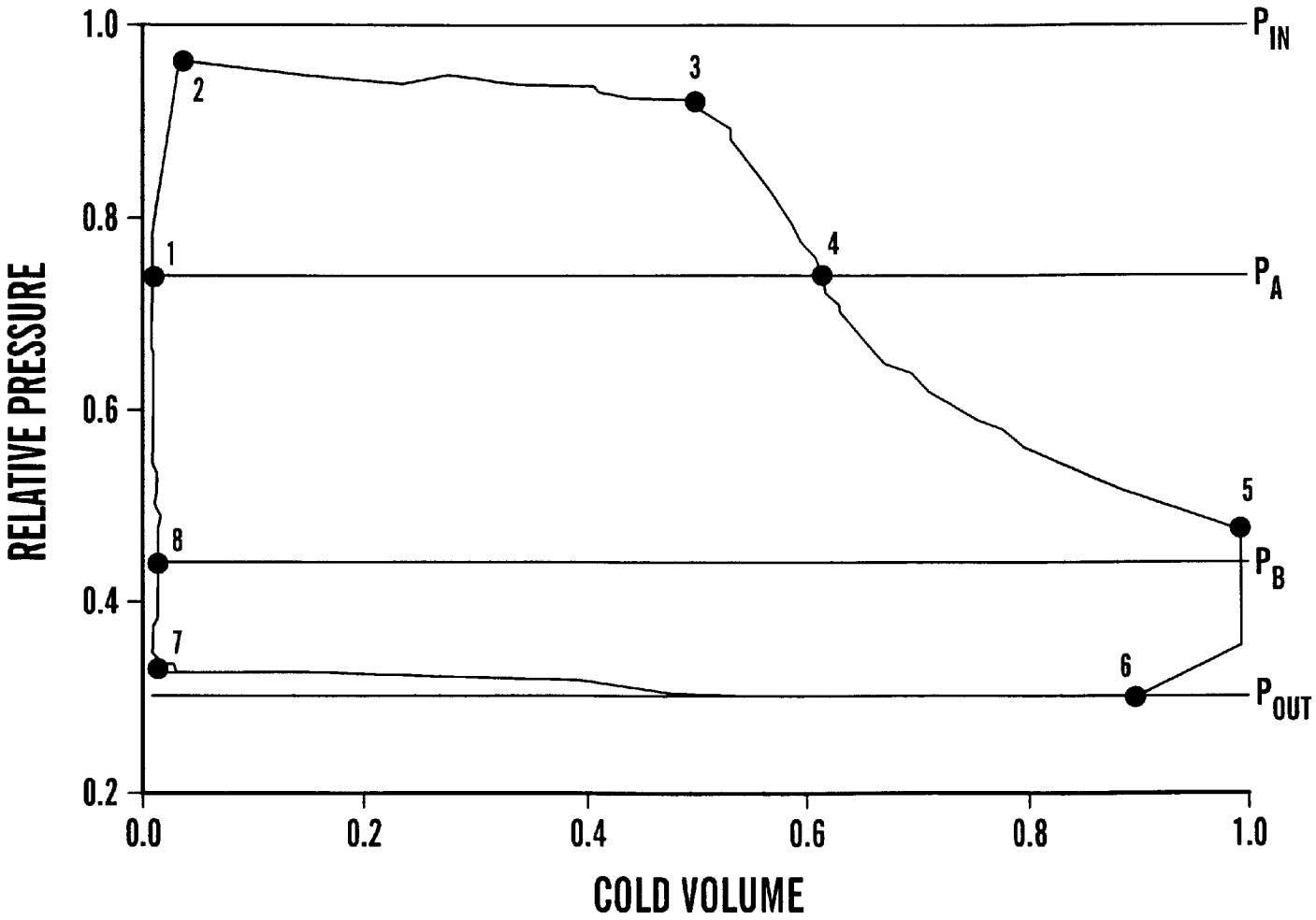
FIG. 3 is a pressure-volume diagram of the floating piston expander of FIG. 2.

Turning now to FIG. 3, a pressure-volume diagram for the cold volume 19 of the expander 14 is shown. The state points 1 through 8 in the diagram indicate the valving sequence. At state 1, the piston 16 is disposed at the bottom (cold volume 19 end) of the cylinder 18 with the pressure of cold volume 19 at $P_A$, which is the pressure of the ballast volume A (ballast volume 25). At state 1, both cold valves 28 and 30 are closed, ballast valve 24 is open and ballast valve 26 is closed. The cold inlet valve 30 is opened to move to state 2.

Once this valve is opened, the pressure in the cold volume 19 builds rapidly to $P_{in}$, since the inlet valve 30 is free breathing. As a result of the pressure difference across the piston 16, the piston moves axially within the cylinder 18 towards the warm end volume 21 to compress the gas in the warm volume 21 to $P_{in}$. The pressure difference across ballast valve 24 will generate warm gas flow from warm volume 21 to ballast volume 25.

As mentioned hereinabove, the rate of flow is controlled by the throttling action of valve 24. Once the piston 16 has moved to a pre-determined cutoff location within the cylinder 18 the cold inlet valve 30 is closed at state 3. This pre-determined cutoff location is selected in combination with the throttling action of the warm valve 24 to help optimize the expansion of the working fluid to substantially achieve the aforementioned nearly isentropic expansion. With the inlet valve 30 closed, the piston 16 continues to move towards warm volume 21 as the pressure in the warm and cold volumes 21 and 19, respectively, drop to $P_A$ at state 4. At this state 4, ballast valve 24 is closed and ballast valve 26 is opened.

Expansion of the gas in the cylinder 18 continues as the pressure in the warm and cold volumes 21 and 19 drops to near $P_B$ (the pressure of ballast volume 27) at state 5, as the piston 16 reaches the top (warm end) of the cylinder 18. The rate of motion of the piston 16 during the expansions from states 3 to 4 and from state 4 to 5 is controlled by the flow of gas through valves 24 and 26. At state 5, the cold exhaust valve 28 is opened and the pressure decreases to $P_{out}$ at state 6.

The motion of the piston 16 during the rapid pressure decrease is limited by the relatively small amount of gas in the warm volume 21. Since the pressure $P_B$ within the ballast volume 27 is greater than $P_{out}$, warm gas flows from ballast volume 27 to move the piston 16 down the expander cylinder 18 at a rate controlled by the flow resistance of warm valve 26. The expanded cold gas within the cold volume 19 is thus moved out of the cold volume 19 as the piston moves down to the cold volume 19 end of the cylinder.

State 7 is reached once the piston 16 reaches the cold volume 19 end of the cylinder 18, at which point the cold volume 19 is close to zero and the cold exhaust valve 28 is closed. Once valve 28 is closed, pressure within the cylinder 18 builds to $P_B$ at state 8, as warm gas continues to flow into the warm volume 21 from the ballast volume 27. Once the pressure reaches $P_B$ at state 8, ballast valve 26 is closed and ballast valve 24 is opened. Warm gas flows from ballast volume 25 into warm volume 21 until the pressure therein reaches $P_A$ while the piston 16 remains at the cold volume 19 end of the cylinder 18 with the cold volume 19 at about zero. This completes the cycle of operation of the expander 14.

An important aspect of the present invention is that ballast volume pressures $P_A$ and $P_B$ are stable when warm valves 24 and 26 are sequenced as discussed hereinabove. This aspect advantageously enables the present invention to operate continuously, nominally without the need for addition or subtraction of ballast fluid. Thus, at steady state operation, the flow into ballast volume 25 from states 1 to 4 nominally equals flow out of volume 25 from states 8 to 1. For ballast volume 27, the flow in from states 4 to 5 nominally equals the flow out from states 5 to 8.

In an exemplary expander 4, $P_{in}$ is approximately 50 psia and the maximum cold volume 19 is approximately 2.7 $inch^3$. Such an exemplary expander 14 was constructed and demonstrated that pressures $P_A$ and $P_B$ reached steady state values determined by pressures $P_{in}$ and $P_{out}$ in combination with the predetermined cutoff volume at which cold inlet valve 30 closes at state 3.

Another important aspect of the present invention is that the floating piston 16 does not require close clearance seals between the piston 16 and the cylinder 18. In this regard, since the piston 16 is of relatively low mass and floats with the gas in the cylinder 18, the pressure difference between the warm and cold volumes 21 and 19 respectively, is limited. In addition, at steady state operational conditions, the average total mass within the warm end is constant. Any leakage from the cold end 19 to the warm end 21 through the gap between the piston 16 and cylinder 18 is effectively balanced by leakage from the warm end 21 to the cold end 19. This oscillating flow in the gap does not create significant heat leakage since the gap acts as an effective balanced flow regenerator. In other words, the gap 23 will enable the piston 16 and cylinder 18 to operate as a regenerative heat exchanger due to the relatively large axial distance along the piston 16 and cylinder 18 from the warm end 21 and cold end 19, and the relatively large surface area and small volume of the gap 23 therebetween. Thus, heat that may be transferred from the warm gas during leakage into the gap 23 during expansion of the warm volume 21 will tend to be absorbed by the piston 16 and cylinder 18, and subsequently transferred back to the cold gas leaking into gap 23 during subsequent expansion of cold volume 19.

In addition, the floating piston 16 remains properly centered (i.e., axially) within the cylinder 18 since it reaches nominally zero volume condition at both ends of every stroke (due to the valve timing).

As mentioned hereinabove, the modular cryocooler 10 of the present invention utilizes "smart" electromechanical valves to serve as valves 24, 26, 28 and 30 of the expander 14. These valves are fabricated substantially as disclosed in U.S. Pat. No. 5,211,372 to Smith, Jr., (the "'372 patent") which is fully incorporated by reference herein. As disclosed in the '372 patent, the valves include mechanical flexures or valve disk assemblies to effect movement of an armature, rather than utilizing guides having sliding contact with one another. Moreover, the valve disk assemblies advantageously provide a non-linear spring rate which serves to reduce the "hold-open" force required to maintain the valve in its open state and, accordingly, reduce the heat which tends to be generated by a hold-open current used in an associated cryogenic solenoid actuator. The valve also preferably utilizes a variable reluctance magnetic circuit in combination with the variable rate mechanical flexures. This combination advantageously provides long life and relatively low mechanical dissipation. The valves are also provided with an electronic drive circuit that effectively matches the force-position characteristics imposed by the gas pressure and spring force of the valve. This driving circuit delivers a shaped current pulse that provides a relatively high force for a few milliseconds to lift the valve off it's seat and overcome the force generated by the gas pressure differential, which decays relatively rapidly as the valve begins to open. As the valve continues to open, the driving circuit delivers a relatively low level of current to continue the motion of the valve to it's fully opened position and to hold the valve in this fully open position. This shaping of the current pulse thus provides adequate opening force but avoids high velocity impacts that would result if a constant voltage were applied to the valve. This shaped current pulse thus advantageously provides long life and contributes to the relatively low electrical dissipation of the valves. Suitable "smart" valves include electromechanical linear actuators of the type commonly utilized in automatic control devices/applications, such as, for example, in factory automation. Such valves typically include integral driver circuits to provide a specified mechanical force, position and velocity output.

Turning now to FIG. 4, the cryocooler module 10 of the present invention including the integrated expander 14 and heat exchanger 12, as well as the microprocessor 50, is shown in greater detail. As shown, the heat exchanger 12 is recuperative, utilizing two flow pathways 62 and 64, each having unidirectional flow therein. Utilizing this relatively simple two flow path construction advantageously simplifies the cryocooler 10 of the present invention relative to large-scale Collins Cycle cryocoolers which generally utilize heat exchangers having three or more flow passages, each of which operate at a different pressure. The two-passage heat exchanger 12 of the present invention tends to simplify manifold design while permitting unidirectional flow in each passage. Such unidirectional flow reduces thermal losses relative to the oscillating pressure flow associated with regenerative (i.e., one-passage) heat exchangers typically utilized in Gifford McMahon and Sterling Cycles, as discussed hereinabove, and thus permits the present invention to operate at relatively higher pressure ratios for increased refrigeration capacity.

As also shown in FIG. 4, the heat exchanger 12 preferably utilizes cross-counter flow in an annular space formed around the expander cylinder 18. The expander cylinder 18 will form the inner diameter (I.D.) of this annular space and a concentrically disposed tube having a relatively larger diameter will form the outer wall 70 thereof, to form the low pressure flow path 64. Relatively small diameter thin tubing wound helically within the annular low pressure flow path 64 forms the high pressure flow path 62. During operation, high pressure gas from the compressor 66 (FIG. 1) will feed into the high pressure flow path 62 at high pressure inlet 72 disposed at the warm volume 21 end of the expander 14. Terminal ends of the high pressure flow path 62 will manifold directly into the plenum of inlet valve 30 of the expander 14 at the cold volume 19 end of the expander as shown. Low pressure gas emitted from the cold volume 19 through valve 28 is split, as shown, between the precooling flow output pathway 13 and the low pressure second flow path 64. The low pressure flow path 64 connects directly to the compressor 66 (FIG. 1) at a low pressure outlet 74 disposed at the warm volume 21 end of the expander 14. The flow split between the precooling pathway 13 and the low pressure flow path 64 is adjusted with low pressure valves (not shown) preferably disposed at the warm end of the expander 14. For the last (i.e., coldest) module (module 310 in FIG. 1) of a system 60 utilizing N modules all of the low pressure gas emanating from the valve 28 will feed from the exhaust plenum thereof to the heat load Q (i.e., through output pathway 13) and subsequently returned to the low pressure flow path 64 (i.e., path 364 in FIG. 1) preferable at the cold end of the expander 14. In this manner the high pressure flow through pathway 62 travels in the opposite axial direction of the low pressure flow through flow path 64, while the high pressure gas also flows helically through the axial flow within 64 to provide the heat exchanger 12 with cross-counter flow therethrough.

Heat exchanger 12 will be matched and coordinated with the desired dimensions of the expander 14. In this regard, the skilled artisan will recognize that the fin spacing and the annular width W of the low pressure passage 64 will be matched to provide a predetermined NTU (Number Transfer Unit) and a ΔP/P (pressure loss) for the low pressure flow, with a flow length that matches the axial length of the expander cylinder 18. Those skilled in the art will recognize that NTU is defined by the relation:

$$NTU = \frac{hA}{mC_p}$$

Where h is the surface heat transfer coefficient in the relation $$q = hA\Delta T$$

where q is the rate of heat transfer, A is the surface area for heat transfer and ΔT is the temperature difference between the surface temperature and the mean fluid temperature flowing over the surface. m is the fluid mass low rate over the surface and $C_p$ is the heat capacity of the fluid.

The heat exchanger 12 extends co-extensively with the cylinder 18 in the axial direction as shown. Similarly, the tube diameter and the number of tubes for the high pressure passage 62 will be selected to provide the desired NTU and ΔP/P for the high pressure flow. As mentioned hereinabove, the axial location of a pre-cooling input port (not shown) for receiving pre-cooling flow from an output pathway 13 of an upstream module 10, will be determined to provide a desired ratio of NTU's for the upper and lower (i.e., warm and cold) portions of the heat exchanger 12.

An exemplary cryocooler 10 is expected to have an axial length of approximately 20 to 30, with a piston having a length of about 10 to 20 inches with flow path 62 formed from a tube having a diameter from 0.032 to 0.062 inches, with fin densities as high as 200 fins per inch. Finned tubing on this scale is commercially available on a custom basis as helically wound and soldered micro-finned tubing, such as from Fin Tube Products, Incorporated, of Wadsworth, Ohio. While finned tubes with tube diameters as small as 0.015 inches have been produced, fin spacing on these tubes has been limited to approximately 140 fins per inch. It may also prove feasible for mechanical or photochemical machine processes to provide tubing suitable for use in the present invention by cutting or etching fins into a relatively thick wall tube. As a further alternative, it may be feasible to scale down conventional processes used to manufacture extruded high finned tubing. While this latter approach is typically only used with tubing of about 0.5 inch OD and greater, and with fin spacing of up to 40 fins per inch, it is mechanically feasible to extend the technique to smaller tubes and higher fin densities.

In a multi-stage system 60 such as shown in FIG. 1, each cryocooler module 10, 110, etc., preferably has the same temperature ratio ΔT/T. Moreover, the constant ΔT/T in the upper (warm) end of the heat exchanger 12 is utilized to determine the pre-cooling flow for each stage. The ΔT/T for the heat exchanger 12 utilized in the present invention is expected to be in the range of about 0.1 to 0.05. An optimization of the loss due to pressure drop verses ΔT of the heat exchanger preferably provides a total ΔP/P to be about 50 percent of the ΔT/T for the heat exchanger 12. Furthermore, system 60 of the present invention may conveniently utilize two conventional high-speed positive displacement refrigeration compressors in series (not shown) to provide a desired pressure ratio of 18 to 1. This high pressure ratio significantly reduces the mass flow required for a given refrigeration load and consequently reduces the size of the heat exchangers 12, etc.

Figure 5:
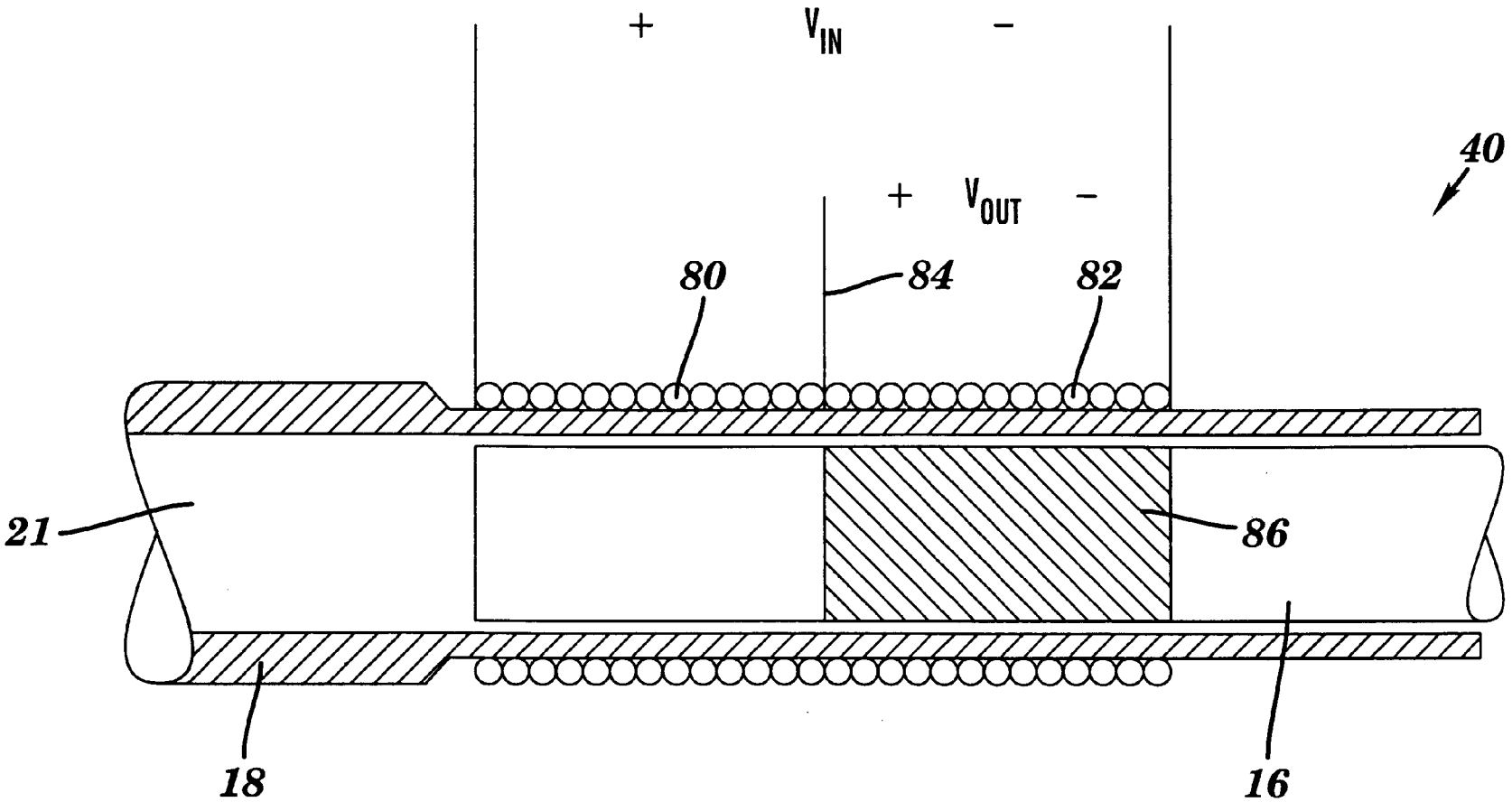
FIG. 5 is a transverse cross-sectional view of a portion of the floating piston expander of FIG. 2, including a non-invasive sensor for detecting the position of the piston therein.

Turning now to FIG. 5, to detect the position of the piston 16, a non-invasive (i.e., non-contact) sensor such as an LVDT (Linear Variable Differential Transformer) is integrated into the piston 16 and cylinder 18. As shown, inductive coils 80 and 82 are wound around the warm end of cylinder 18. The coils preferably form two layers (not shown) with a center tap 84 disposed between the coils 80 and 82. A steel shim 86 or other ferromagnetic material is disposed on the piston 16 such as with epoxy or other mechanical or chemical fastener. An alternating current excitation voltage, shown as vines applied across the full axial length of the two coils 80 and 82 and the output voltage $v_{out}$, taken at the tap 84 is utilized to determine the axial position of the piston 16 within the cylinder 18, in a manner that will be familiar to those skilled in the art of LVDT sensors. In a preferred embodiment, the ac output signal generated by the LVDT is converted to a dc signal, which varies proportionately with the position of the piston 16. Such conversion may be provided by any convenient means known to those skilled in the art, such as by use of a lock-in amplifier. Such a dc output signal advantageously provides compatibility with the data acquisition system, which includes microprocessor 50.

Both static and dynamic pressure conditions are preferably monitored throughout the system 60. Static pressure measurements were obtained utilizing conventional gages on the high pressure inlets 72 and in the ballast volumes 25 and 27. In addition, the transient pressures inside the expander 14 were monitored and coupled to microprocessor 50 to control operation of the cryocooler 10. For example, in the warm volume region 21, a pressure transducer (not shown) such as a conventional strain gage pressure transducer was utilized. The signal from this transducer is routed to the microprocessor 50. Similarly, the pressure in the cold region 19 of the expander 14 is also monitored, such as by a piezo-quartz pressure transducer. An example of such a transducer is a Kistler Instrument Corporation, Model 603 B3, utilized in combination with a Kistler, Model 5004, charge amplifier. The output signal corresponding to the pressure in cold region 19 is also coupled to the microprocessor 50.

The temperature of the working fluid is also preferably acquired by the data acquisition system at various points throughout the flow thereof. Conventional temperature sensors, such as Type E thermocouples (thermoconstantan) or Type T thermocouple (copper metal-constantan) are preferably utilized along with appropriate cold-junction compensating units, as will be familiar to those skilled in the art. The thermocouples (not shown) are preferably coupled to the microprocessor 50.

The operation of the expander 14 is monitored by the microprocessor 50, utilizing the output generated by the pressure transducers, temperature sensors and the LVDT 40 as discussed hereinabove. The output of the microprocessor 50 controls the inlet and exhaust valves 24, 26, 28 and 30. In an exemplary embodiment, microprocessor 50 includes a DAS-20 data acquisition board, manufactured by Keithley MetraByte Corporation. Microprocessor 50 is programmed with a control program to perform all I/O operations. All required calculations to control the system are preferably performed within this control program. An exemplary embodiment of the control program, written in QBasic 4.5 is included in Appendix A hereinbelow.

In a preferred embodiment, the control program is divided into a manual mode and an automatic mode, to provide control of the cryocooler 10 and data storage. The manual mode provides for initialization of the system and trouble shooting any problems in the system. In addition, the manual mode enables transfer of data acquired during automatic operation, to disk for manipulation. Six operations in this manual mode are shown in the following Table 1. As shown in the following Tables, a single 5/2 spool valve of a type familiar to those skilled in the art may be connected between warm volume 21 and the two ballast volumes 25 and 27, as a substitute for separate values 24 and 26.

TABLE 1

| KEY PRESS | OPERATION |
|---|---|
| I | Toggle inlet valve 30 opened/closed |
| E | Toggle exhaust valve 28 opened/closed |
| T | Toggle 5/2-Spool valve (i.e., open/close valve 24 and close/open valve 26) |
| A | Write QBasic data array to A:÷rive |
| B | Begin automatic operation |
| X | Terminate program and return to code |

Figure 6:
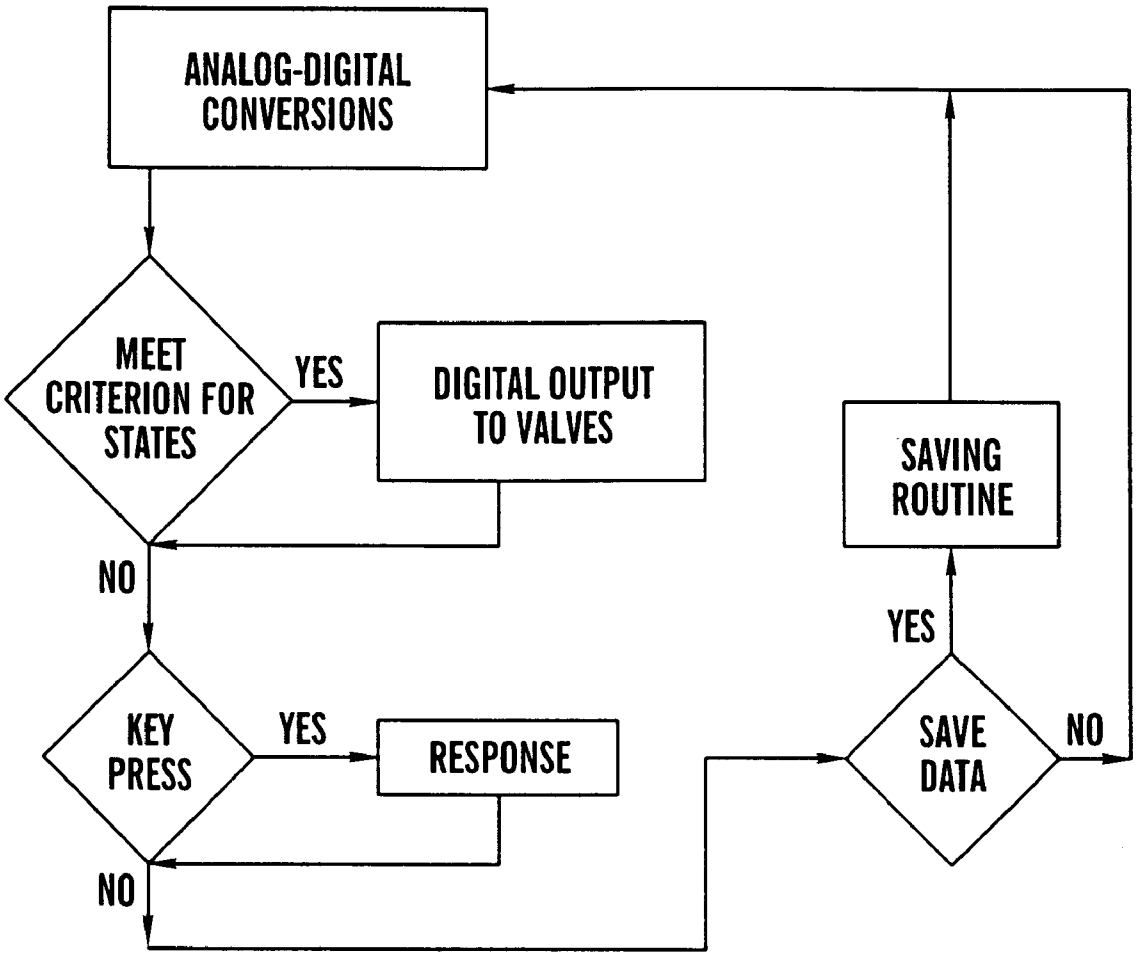
FIG. 6 is a flow chart representation of a control program utilized to operate the cryocooler of FIG. 4.

The automatic mode is illustrated in the flow chart of FIG. 6. As shown, this mode includes the steps of sampling data generated by the sensors to determine the appropriate response and saving the data for manipulation. The sampling rate of the data should be sufficiently fast to capture the transient behavior. However, if the sampling rate is too fast, an excessive number of data points may be generated during the slower processes of the expander operation. The control program thus includes adjustable wait loops, which allow the sampling rate to be adjusted as desired. After the data is sampled, the data is utilized to determine the state of the expander and what action, if any, is required. The following Table 2 indicates the specific action implemented by the control program at a particular state.

TABLE 2

| STATE | ACTION |
|---|---|
| 1 | Open inlet valve 30 |
| 3 | Close inlet valve 30 |
| 4 | Toggle 5/2 spool valve (close valve 24, open valve 26) |
| 5 | Open exhaust valve 28 |
| 7 | Close exhaust valve 28 |
| 8 | Toggle 5/2-Spool valve (open valve 24, close valve 26) |

The digital output signals generated by microprocessor 50 are coupled to the valves as shown in FIG. 4. Moreover, the control program determines the state of the cycle by comparison of the current data set with the previous data set relative to a preset value. For example, when the program distinguishes between states 1, 4 and 5 or states 7 and 8, the signals on the digital output channels are sampled to determine the previous output signal and the appropriate new signal. If the sample data does not match one of the pre-defined states, the expander is in an undefined situation and the system is shutdown automatically to prevent damage.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention, such as disclosed by R. E. Jones, in Design and Testing of Experimental Free-Piston Cryogenic Expander, Masters Thesis, MIT, February 1999, which is fully incorporated by reference herein.

Appendix A: QBasic control program

```
''''''
```

-continued

Appendix A: QBasic control program

```
390 LOCATE 9, 5 PRINT "B - Begin automatic operation"
400 LOCATE 13, 5: PRINT "X - Terminate program"
405 '---- digital output initialization---------------
410 DIO%(0) = 7
415 GOTO 800
420 '---Detennine key press for manual operation----------
430 M$ = INKEY$: IF M$ = "" GOTO 430
440 IF M$ = "I"OR M$ = "i" THEN GOTO 450 ELSE GOTO 500
450 LOCATE 5, 22: IF (DIO%(0) AND 1) = 0 THEN GOTO 480
460 DIO%(0) = DIO%(0) - 1: PRINT "Open"
470 GOTO 800
480 DIO%(0) = DIO%(0) + 1: PRINT "Closed": GOTO 800
500 IF M$ = "E" OR M$ = "e" THEN GOTO 510 ELSE GOTO 550
510 LOCATE 6, 22: IF (DIO%(0) AND 2) = 0 THEN GOTO 540
520 DIO%(0) = DIO%(0) – 2: PRINT "Open "
530 GOTO 800
540 DIO%(0) = DIO%(0) + 2: PRINT "Closed": GOTO 800
550 IF M$ = "T" OR M$ = "t" THEN GOTO 560 ELSE GOTO 600
560 LOCATE 7, 22: IF (DIO%(0) AND 4) = 0 THEN GOTO 590
570 DIO%(0) = DIO%(0) - 4: PRINT "Tank B"
580 GOTO 800
590 DIO%(0) = DIO%(0) + 4: PRINT "Tank A": GOTO 800
600 IF M$ = "A" OR M$ = "a" THEN LOCATE 17, 1 ELSE GOTO 730
610 PRINT "Transfering data to file": OPEN "A:ØUTPUT.DAT" FOR OUTPUT AS #2
611 WRITE #2, X2
612 WRITE #2, DTPT
620 FOR K = 0 TO DTPT
630 WRITE #2 P(K)
640 NEXT K
645 CLOSE #2
650 LOCATE 17, 1: PRINT "Data transfer complete"
660 GOTO 420
730 IF M$ = "B" OR M$ = "b" THEN DOUT = DIO%(0): GOTO 1000
740 IF M$ = "X" OR M$ = "x" THEN STOP
750 GOTO 420
790'----- Digital output routine----------------------
800 MD% = 15
810 CALL DAS20(MD% VARPTR(DIO%(0)), FLAG%)
820 IF FLAG% <>0 THEN PRINT "Error #"; FLAG%; "on digital output"
830 GOTO 420
1000 '---- Setting A/D pacer clock----------------------
1010 DIO%(0) = 2000     This divides 5MHz by the two input values
1020 DIO%(1) = 0
1030 MD% = 24
1040 CALL DAS20(MD%, VARPTR(DIO%(0)), FLAG%)
1050 IF FLAG% <> 0 THEN PRINT "Error #"; FLAG%; "in setting timer": STOP
1060 '---- Load ADC control queue----------------------------
1070 MD% = 0
1080 DIO%(0) = 0                    'Set channel
1090 DIO%(1) = 4                    'Select gain
1100 DIO%(2) = 2                    'Set as first entry in queue
1110 CALL DAS20(MD%, VARPTR(DIO%(0)), FLAG%)
1115 IF FLAG% <> 0 THEN PRINT "Error #"; FLAG%; "in setting queue": STOP
1120 DIO%(0) = 2                         'Select channel
1130 DlO%(1) = 0                         'Select gain
1140 DIO%(2) = 0                         'Set as normal entry in queue
1150 CALL DAS20(MD%, VARPTR(DIO%(0)), FLAG%)
1155 IF FLAG% <> THEN PRINT "Error#"; FLAG%; "in setting queue": STOP
1160 DIO%(0) = 3                    'Select channel
1170 DIO%(1) = 3                    'Select gain
1180 DIO%(2) = 0                    'Set as normal entry in queue
1190 CALL DAS20(MD%, VARPTR(DIO%(0)), FLAG%)
1195 IF FLAG% <> 0 THEN PRINT "Error #"; "FLAG%; "in setting queue": STOP
1200 DIO%(0) = 5                    'Select channel
1210 DIO%(1) = 7                    'Select gain
1220 DIO%(2) = 0                    'Set as normal entry in queue
1230 CALL DAS20(MD%, VARPTR(DIO%(0)), FLAG%)
1235 IF FLAG% <> 0 THEN PRINT "Error#"; FLAG%; "in setting queue": STOP
1240 DIO%(0) = 6                    'Select channel
1250 DIO%(1) = 7                    'Select gain
1260 DIO%(2) = 0                    'Set as normal entry in queue
1270 CALL DAS20(MD%, VARPTR(DIO%(0)), FLAG%)
1275 IF FLAG% <> 0 THEN PRINT "Error #"; FLAG%: "in setting queue": STOP
1280 DIO%(0) = 7                    'Select channel
1290 DIO%(1) = 0                    'Select gain
1300 DIO%(2) = 1                    'Set as last entry in queue
1310 CALL DAS20(MD%, VARPTR(DIO%(0)), FLAG%)
```

-continued

Appendix A: QBasic control program

```
1315 IF FLAG% <> 0 THEN PRINT "Error #"; FLAG%; "in setting queue": STOP
1320 '---- Write automatic operation instructions to the screen------
1330 CLS
1340 LOCATE 1, 1: PRINT "Operation Mode: AUTOMATIC"
1350 LOCATE 3, 5: PRINT "U - Increase X2"
1360 LOCATE 4, 5: PRINT "D - Decrease X2"
1370 LOCATE 6, 5: PRINT "W - Write data to memory"
1380 LOCATE 8, 5: PRINT "S - Stop automatic operation/Return to Manual"
1390 '---- Initialize variables for automatic operation-------
1400 X2 = 2500: STPT 1: DTPT = 3599: INC = 100
1410 DPR = 1: DV = 1: DX =40: CW = 3: XMIN = 0; TDV =0
1420 WTL = 1600: SC = 0: AC = 0: XX = 0
1600 '---- Obtain ADC values and store in DT%()----------------
1605 LOCATE 4, 50: PRINT "X2 ="; X2
1610 MD% = 4
1620 DIO%(0) = 6                    'Number of Conversions
1630 DIO%(1) = VARPTR(DT%(0))       'Provide array location write to
1640 DIO%(2) = 2                    'Internal timer/No gate
1650 CALL DAS20(MD%, VARPTR(DIO%(0)), FLAG%)
1660 IF FLAG% <> 0 THEN PRINT "Error #"; FLAG%; "in mode 4": STOP
1670 '---- Stop internal timer for ADC-------------------
1680 MD% = 26
1690 DIO%(0) = 0                    'Stop A/D timer
1700 CALL DAS20(MD%, VARPTR(DIO%(0)) FLAG%)
1710 '---- Signal monitoring and controls loop -------------
1790 LOCATE 10, 1
1800 FOR KK = 0 TO 5
1810 PRINT DT%(KK), TEMP%(KK)
1820 NEXT KK
2000 IF X <> 0 THEN GOTO 12000
3000 IF ABS(DT%(0),- TEMP%(0)) > DV THEN GOTO 9000
4000 IF ABS(DT%(1) - TEMP%(1)) > DPR THEN GOTO 13000
5000 IF ABS(DT%(0)) - XMIN) > DX THEN GOTO 7000
6000 IF DOUT = 1 THEN DOUT = 3; GOTO 8000
6010 IF DOUT = 3 THEN DOUT = 7; GOTO 8000
6020 IF DOUT = 7 THEN DOUT = 6; GOTO 8000
6030 GOTO 11000
7000 IF DOUT = 7 THEN DOUT = 3: GOTO 8000
7010 IF DOUT = 3 THEN DOUT = 1: GOTO 8000
7020 GOTO 11000
8000 MD% = 15
8010 DIO%(0) = DOUT
8020 CALL DAS20(MD%, VARPTR(DIO%(0)), FLAG%)
8030 IF FLAG% <> 0 THEN PRINT "Error #": FLAG% "on digital output"
8040 X = CW: GOTO 13000
9000 IF DOUT <> 6 THEN GOTO 13000
10000 IF (DT%(0) – X2) <0 THEN GOTO 13000
10010 DOUT = 7: GOTO 8000
11000 LOCATE 20, 1: PRINT "ILLEGAL SIGNAL!!!!": SLEEP: GOTO 320
12000 X = X – 1
13000 FOR K = 0 TO 5: TEMP%(K) = DT%(K)
13010 NEXT K
13020 FOR TD = 0 TO TDV
13030 NEXT TD
20000 '--- Determine key press for automatic operation -------------
20010 A$ = INKEY$: LOCATE 4, 50
20020 IF A$ = "U" OR A$ = "u" THEN X2 = (X2 + INC): PRINT "X2="; X2
20030 IF A$ = "D" OR A$ = "d" THEN X2 = (X2 – INC): PRINT "X2 ="; X2
20040 IF A$ = "S" OR A$ = "s" THEN GOTO 320
20049 LOCATE 19, 1
20050 IF A$ = "W" OR A$ = "w" THEN WTL = 20100: PRINT TIME$
20060 IF WTL = 1600 THEN GOTO 1600
20070 IF WTL = 20100 THEN GOTO 20100
20100 '--- Check for counter to save data-------------------
20110 SC = SC + 1
20120 IF SC = STPT THEN GOTO 30000 ELSE GOTO 1600
30000 '--- Saving data to array P() subroutine--------------
30010 FOR K = AC TO (AC + 5)
30015 P(K) = TEMP% (K – AC)
30020 NEXT K
30030 AC = AC + 6: SC = 0
30040 IF AC > DTPT THEN GOTO 30200
30050 LOCATE 17, 1: PRINT "Saving data": GOTO 1600
30200 WTL = 1600: AC = 0
```

-continued

Appendix A: QBasic control program

```
30210 LOCATE 20, 1: PRINT TIME$
30220 LOCATE 17, 1: PRINT"          ":GOTO 1600
50000 END
```

Having thus described the invention, what is claimed is:

1. A system for providing a low temperature fluid, said system comprising:

a compressor;

a recuperative heat exchanger disposed in fluid communication with said compressor; and a floating piston expander being free from engagement with rubbing-type seals, disposed in fluid communication with said heat exchanger.

2. A system for providing a low temperature fluid, said system comprising:

a compressor;

a recuperative heat exchanger disposed in fluid communication with said compressor; and a floating piston expander disposed in fluid communication with said heat exchanger;

said compressor providing fluid under pressure, said compressor having an input and an output;

said recuperative heat exchanger having discrete first and second flow paths extending therethrough, said first flow path being coupled to said input and said second flow path being coupled to said output; and said floating piston expander being disposed in serial fluid communication with said first and second flow paths, wherein said first flow path is coupled through said floating piston expander to said second flow path.

3. The system of claim 2, wherein said floating piston expander comprises a piston disposed for periodic axial movement within an elongated chamber, said piston having a range of motion extending between a cold displacement volume disposed at one end of said chamber and a warm displacement volume disposed at an other end of said chamber, said first and second flow paths being selectively coupled to said cold displacement volume and first and second ballast volumes being selectively coupled to said warm displacement volume.

4. The system of claim 3, further comprising a flow restriction disposed between said warm displacement volume and at least one of said first and second ballast volumes, wherein flow of fluid from said warm displacement volume is restricted.

5. The system of claim 4, further comprising a flow restriction disposed between said warm displacement volume and the other of said first and second ballast volumes, wherein flow of fluid to said warm displacement volume is restricted.

6. The system of claim 4, wherein said first and second ballast volumes are alternately coupled to said warm displacement volume to generate movement of said piston from said cold displacement volume towards said warm displacement volume and generate substantially isentropic expansion of the fluid under pressure disposed within said cold displacement volume.

7. The system of claim 6, further comprising decoupling the cold displacement volume from said first flow path during said periodic axial movement prior to said piston reaching the warm end of its range of motion.

8. The system of claim 2, wherein said heat exchanger is integrally coupled to said floating piston expander to form a modular unit.

9. The system of claim 2, wherein said floating piston expander comprises a piston disposed for axial movement within an elongated chamber between a cold displacement volume disposed at one end of said chamber and a warm displacement volume disposed at an other end of said chamber.

10. The system of claim 8, wherein, said heat exchanger is disposed coaxially with said elongated chamber.

11. The system of claim 10, wherein said floating piston expander and said heat exchanger extend co-extensively in the axial direction.

12. The system of claim 11, wherein at least one of said first and second flow paths are disposed helically about said floating piston expander.

13. The system of claim 8, further comprising N modular units coupled in parallel to said compressor, and individual ones of said N modular units are coupled to one another by a single fluid pathway.

14. The system of claim 8, wherein said modular unit comprises a single output pathway adapted for fluid communication with a first other modular unit, and a single input pathway adapted for fluid communication with a second other modular unit.

15. The system of claim 8, wherein said modular unit further comprises first and second ballast volumes selectively coupled to said floating piston expander.

16. The system of claim 2, further comprising at least one valve adapted for selectively coupling and decoupling first and second ballast volumes to said floating piston expander.

17. A system for providing a low temperature fluid, said system comprising:

a compressor to provide fluid under pressure, said compressor having an input and an output;

a heat exchanger disposed in fluid communication with said compressor, said heat exchanger having discrete first and second flow paths extending therethrough, said first flow path being coupled to said input and said second flow path being coupled to said output;

a floating piston expander disposed in serial fluid communication with said first and second flow paths, wherein said first flow path is coupled through said floating piston expander to said second flow path;

said floating piston expander having a piston disposed for periodic axial movement within an elongated chamber, said piston having a range of motion extending between a cold displacement volume disposed at one end of said chamber and a warm displacement volume disposed at an other end of said chamber, said first and second flow paths being selectively coupled to said cold displacement volume, and first and second ballast volumes being selectively coupled to said warm displacement volume; and said first and second ballast volumes being alternately couplable to said warm displacement volume to generate movement of said piston from said cold displacement volume towards said warm displacement volume and generate substantially isentropic expansion of the fluid under pressure disposed within said cold displacement volume.

18. An expander adapted for use in a thermodynamic cycle, said expander comprising:

an expansion chamber;

a piston adapted for periodic movement within said expansion chamber, said piston being free from an external drive mechanism;

said piston being actuated by alternately coupling and decoupling fluid thereto;

a plurality of variable force valves to effect said coupling and decoupling;

a sensor adapted to detect the location of said piston within said expansion chamber, said sensor being free from physical contact with said piston; and a computer coupled to said sensor to control operation of said plurality of variable force valves.

19. The expander of claim 18, further comprising a heat exchanger having discreet first and second flow paths extending therethrough, said expander being disposed in serial fluid communication with said first and second flow paths, wherein said first flow path is coupled through said expander to said second flow path.

20. The expander of claim 19, wherein said heat exchanger is integrally coupled to said expander to form a modular unit.

21. The expander of claim 19, wherein said piston is adapted for periodic movement between a cold displacement volume disposed at one end of said chamber and a warm displacement volume disposed at an other end of said chamber.

22. The expander of claim 20, wherein said heat exchanger is disposed coaxially with said expansion chamber.

23. The expander of claim 22, wherein at least one of said first and second flow paths are disposed helically about said expander.

24. The expander of claim 20, further comprising a single output pathway adapted for fluid communication with a first other expander, and a single input pathway adept for fluid communication with a second other expander.

25. The expander of claim 19, further comprising at least one valve adapted for alternately coupling and decoupling first and second ballast volumes to said expander.

26. The expander of claim 25, wherein said first and second flow paths are alternately coupled to a cold displacement volume of said floating piston expander and said first and second ballast volumes are alternately coupled to a warm displacement volume of said floating piston expander.

27. The expander of claim 20, wherein said modular unit further comprises first and second ballast volumes selectively coupled to said expansion chamber.

28. A method for producing a cold fluid, said method comprising the steps of:

(a) utilizing a compressor having an input and an output to provide fluid under pressure;

(b) disposing a heat exchanger in fluid communication with said compressor, said heat exchanger having discrete first and second flow paths extending therethrough, said first flow path being coupled to said input and said second flow path being coupled to said output;

(c) disposing a floating piston expander in serial fluid communication with said first and second flow paths, said floating piston expander having a piston adapted for periodic, axial movement within an expansion chamber, said piston having a range of motion extending between warm and cold displacement volumes disposed at opposite ends of said expansion chamber, wherein said first flow path is selectively coupled through the cold displacement volume of said floating piston expander to said second flow path;

(d) introducing the fluid under pressure at a first temperature through said first flow path into said cold displacement volume;

(e) pre-cooling the fluid flowing in said first flow path from said first temperature to a second temperature lower than said first temperature;

(f) periodically coupling a low pressure fluid to said warm displacement volume to generate movement of said piston from said cold displacement volume towards said warm displacement volume to expand said cold displacement volume and expand the pressurized fluid flowing into said cold displacement volume from said first flow path, from said pressure to a substantially lower pressure to reduce the temperature thereof to a third temperature substantially lower than said second temperature;

(g) decoupling said low pressure fluid from said warm displacement volume and coupling a high pressure fluid to said warm displacement volume to move said piston towards said cold displacement volume to cause fluid at said third temperature and at said lower pressure to flow from said cold displacement volume at a substantially constant pressure into said second flow path;

(h) providing a direct heat exchange between fluid flowing in said first flow path and fluid flowing in said second flow path to effect the pre-cooling of the fluid flowing in said first flow path substantially to said second temperature and a warming of the fluid flowing in said second flow path; and (i) supplying the fluid from said second flow path to said compressor to provide the fluid under pressure for introduction into said first flow path.

29. The method of claim 28, wherein said step (f) further comprises restricting flow of fluid from said warm displacement volume during movement of said piston.

30. The method of claim 29, wherein said step (g) further comprises restricting flow of fluid to said warm displacement volume during movement of said piston.

31. The method of claim 29, wherein said step (f) is adapted to generate substantially isentropic expansion of the pressurized fluid flowing into said cold displacement volume.

32. The method of claim 31, further comprising decoupling the cold displacement volume from said first flow path during said periodic axial movement prior to said piston reaching the warm end of its range of motion.

33. The method of claim 28, further comprising performing steps (b) through (i) at a plurality of discrete operating stages.

34. The method of claim 33, further comprising coupling said second flow path of each stage, other than the first stage wherein the temperatures thereof are warmer than the corresponding temperatures of the successive stages, to the cold displacement volume of the preceding stage.

35. The method of claim 34, wherein each of said separate operating stages operates parallel with the other operating stages and the fluid at said third temperature at all stages, except one, is coupled to said second flow path of the other operating stages.

36. The system of claim 1, wherein said floating piston expander further comprises a floating piston sized and shaped for sliding receipt within an elongated chamber, said floating piston being substantially incompressible and of sufficiently low mass, wherein said floating piston is adapted for axial reciprocation within the chamber in response to fluid pressure differences at opposite ends thereof, nominally without converting any substantial part of the mechanical work being transferred from the cold volume to the warm volume, into kinetic energy of the piston.

37. The system of claim 18, wherein said piston is sized and shaped for sliding receipt with said expansion chamber, said piston being substantially incompressible and of sufficiently low mass, wherein said piston is adapted for axial reciprocation within said expansion chamber in response to fluid pressure differences at opposite ends thereof, nominally without converting any substantial part of the mechanical work being transferred from the cold volume to the warm volume, into kinetic energy of the piston.

* * * * *